US012798866B2

(12) United States Patent
Popwell et al.

(10) Patent No.: US 12,798,866 B2
(45) Date of Patent: Nov. 17, 2026

(54) CONTACT LENS DISPENSER

(71) Applicant: JOHNSON & JOHNSON VISION CARE, INC., Jacksonville, FL (US)

(72) Inventors: Sam Jonathan Popwell, Jacksonville, FL (US); Daniel Graham Ward, Cambridge (GB); Stephen Sams, Cambridge (GB); William Stephen Honey, Bath (GB)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 268 days.

(21) Appl. No.: 18/720,244

(22) PCT Filed: Dec. 15, 2022

(86) PCT No.: PCT/IB2022/062310

§ 371 (c)(1),
(2) Date: Jun. 14, 2024

(87) PCT Pub. No.: WO2023/111947

PCT Pub. Date: Jun. 22, 2023

(65) Prior Publication Data

US 2025/0051087 A1 Feb. 13, 2025

Related U.S. Application Data

(60) Provisional application No. 63/290,909, filed on Dec. 17, 2021.

(51) Int. Cl.

| | |
|---|---|
| ***A45C 11/00*** | (2006.01) |
| ***B65D 83/08*** | (2006.01) |
| ***B65D 83/766*** | (2025.01) |

(52) U.S. Cl.
CPC ..... *B65D 83/08* (2013.01); *A45C 11/005* (2013.01); *B65D 83/766* (2025.01); *A45C 2011/006* (2013.01)

(58) Field of Classification Search
CPC ..... B65D 83/08; B65D 83/766; A45C 11/005
See application file for complete search history.

(56) References Cited

U.S. PATENT DOCUMENTS

| | | | |
|---|---|---|---|
| 3,159,308 | A | 12/1964 | Lawrence et al. |
| 4,495,313 | A | 1/1985 | Larsen |

(Continued)

FOREIGN PATENT DOCUMENTS

| | | | |
|---|---|---|---|
| GB | 2547206 | A | 8/2017 |
| TW | 377329 | B | 12/1999 |

(Continued)

OTHER PUBLICATIONS

International Search Report and Written Opinion for International Application No. PCT/IB2022/062310, mailed Apr. 19, 2023, 19 Pages.

(Continued)

*Primary Examiner* — Gene O Crawford
*Assistant Examiner* — Ayodeji H Ojofeitimi
(74) *Attorney, Agent, or Firm* — Casimir Jones, S.C.; Thomas J. Lyneis

(57) ABSTRACT

A new contact lens dispenser provides one-touch contact lens handling capabilities. The contact lens dispenser is designed to house a plurality of contact lenses in individual pods, each of which in turn contains a solution to keep the contact lens hydrated. The contact lens dispenser is equipped with an actuator that allows a contact lens to be dispensed out of its pod onto a fingertip ready for insertion in the eye.

38 Claims, 6 Drawing Sheets

(56) References Cited

U.S. PATENT DOCUMENTS

| | | | |
|---|---|---|---|
| 4,659,782 | A | 4/1987 | Spinelli |
| 4,659,783 | A | 4/1987 | Spinelli |
| 4,889,664 | A | 12/1989 | Kindt-Larsen et al. |
| 5,039,459 | A | 8/1991 | Kindt-Larsen et al. |
| 5,244,981 | A | 9/1993 | Seidner et al. |
| 5,314,960 | A | 5/1994 | Spinelli et al. |
| 5,331,067 | A | 7/1994 | Seidner et al. |
| 5,371,147 | A | 12/1994 | Spinelli et al. |
| 5,760,100 | A | 6/1998 | Nicolson et al. |
| 5,776,999 | A | 7/1998 | Nicolson et al. |
| 5,789,461 | A | 8/1998 | Nicolson et al. |
| 5,849,811 | A | 12/1998 | Nicolson et al. |
| 5,965,631 | A | 10/1999 | Nicolson et al. |
| 5,998,498 | A | 12/1999 | Vanderlaan et al. |
| 6,087,415 | A | 7/2000 | Vanderlaan et al. |
| 6,367,929 | B1 | 4/2002 | Maiden et al. |
| 6,471,052 | B2 | 10/2002 | Faxe |
| 6,822,016 | B2 | 11/2004 | McCabe et al. |
| 6,867,245 | B2 | 3/2005 | Iwata et al. |
| 6,943,203 | B2 | 9/2005 | Vanderlaan et al. |
| 7,247,692 | B2 | 7/2007 | Laredo |
| 7,249,848 | B2 | 7/2007 | Laredo et al. |
| 7,553,880 | B2 | 6/2009 | Nicolson et al. |
| 7,666,921 | B2 | 2/2010 | McCabe et al. |
| 7,784,608 | B2 | 8/2010 | Tokarski et al. |
| 7,786,185 | B2 | 8/2010 | Rathore et al. |
| 7,819,241 | B2 | 10/2010 | Post-Smith et al. |
| 7,956,131 | B2 | 6/2011 | Arnold et al. |
| 8,022,158 | B2 | 9/2011 | Rathore et al. |
| 8,273,802 | B2 | 9/2012 | Laredo et al. |
| 8,399,538 | B2 | 3/2013 | Steffen et al. |
| 8,450,387 | B2 | 5/2013 | Mccabe et al. |
| 8,470,906 | B2 | 6/2013 | Rathore et al. |
| 8,487,058 | B2 | 7/2013 | Liu et al. |
| 8,507,577 | B2 | 8/2013 | Zanini et al. |
| 8,637,621 | B2 | 1/2014 | Iwata et al. |
| 8,703,891 | B2 | 4/2014 | Broad |
| 8,937,110 | B2 | 1/2015 | Alli et al. |
| 8,937,111 | B2 | 1/2015 | Alli et al. |
| 8,940,812 | B2 | 1/2015 | Reboul et al. |
| 9,056,878 | B2 | 6/2015 | Fujisawa et al. |
| 9,057,821 | B2 | 6/2015 | Broad et al. |
| 9,125,808 | B2 | 9/2015 | Alli et al. |
| 9,140,825 | B2 | 9/2015 | Alli et al. |
| 9,156,934 | B2 | 10/2015 | Alli et al. |
| 9,170,349 | B2 | 10/2015 | Mahadevan et al. |
| 9,244,196 | B2 | 1/2016 | Scales et al. |
| 9,244,197 | B2 | 1/2016 | Alli et al. |
| 9,260,544 | B2 | 2/2016 | Rathore et al. |
| 9,297,928 | B2 | 3/2016 | Molock et al. |
| 9,297,929 | B2 | 3/2016 | Scales et al. |
| 9,668,558 | B2 | 6/2017 | Clamp et al. |
| 9,701,458 | B2 | 7/2017 | Barrows et al. |
| 9,708,117 | B1 | 7/2017 | Keuleers et al. |
| 10,463,127 | B2 | 11/2019 | Kim |
| 11,071,644 | B2 | 7/2021 | Greenwood et al. |
| 2007/0000792 | A1 | 1/2007 | Newman et al. |
| 2010/0048847 | A1 | 2/2010 | Broad |
| 2010/0065576 | A1* | 3/2010 | Verheij ..... A45D 34/00 604/385.01 |
| 2015/0164290 | A1* | 6/2015 | Leung ..... B65D 83/0841 221/26 |
| 2020/0229563 | A1* | 7/2020 | Almond ..... A45C 11/005 |

FOREIGN PATENT DOCUMENTS

| | | | |
|---|---|---|---|
| WO | WO-03022321 | A2 | 3/2003 |
| WO | WO-2008061992 | A2 | 5/2008 |
| WO | WO-2020152446 | A1 | 7/2020 |

OTHER PUBLICATIONS

EP Search Report for application No. 22830957.1 mailed Jan. 5, 2026; 15 pages.

* cited by examiner

CONTACT LENS DISPENSER

I. BACKGROUND OF THE INVENTION

In a conventional contact lens package, the contact lens typically sits in a molded plastic base having a cavity (or "bowl") that houses the contact lens in a concave-side-up orientation. As a result, the user experience for transferring a contact lens from the package to an eye generally involves the user "fishing" the contact lens out of the bowl with a finger and then flipping the lens so that it is in the correct orientation on the finger for placement on the eye. This process requires touching the lens multiple times, which can transfer contaminants or pathogens from the hand to the lens and ultimately to the eye. Not only is this handling experience unsanitary, but it is also unduly cumbersome, messy, and mechanically stressful to the lens, which can tear, rip, or distort when overly manipulated. While some packages have been designed to present the lens in a convex-side-up orientation to obviate the need for flipping the lens, they often still require the lens to be "fished" from the packaging solution or otherwise necessitate manipulation of the lens and/or multiple touches of the lens to achieve transfer of the lens to the eye.

In view of the growing awareness around ocular health and the customer demand for a more convenient experience, a need has arisen for contact lens packaging that enables a less messy and more sanitary contact lens handling process. In one respect, it would be ideal to provide wearers of contact lenses with a "single touch" package—that is, a package whereby the wearer of contact lenses can take the lens from the lens storage package with a single touch of one of his or her fingers, and then, with this single touch, position the lens correctly on the eye. In such a design, there would be no need for transfer and manipulation of the lens from one finger to another before placing the lens on the eye. Providing such a single touch package would not only streamline the lens preparation and insertion process; it would also diminish the possibility of dropping the lens or exposing the lens to additional bacteria on a wearer's other fingers as the lens is being prepared for orientation and insertion onto the eye, and it also reduces the possibility of touching the side of the lens which is intended to contact the eye.

Thus, there remains a need for contact lens packages and dispensers that address one or a combination of the aforementioned challenges or deficiencies.

II. SUMMARY

It has now been found that some or all the foregoing and related objects may be attained in a contact lens dispensing device and packages for uses therein that have one or more aspects described herein. For example, in an aspect according to principles described herein, a contact lens dispensing device includes a tube having a first end and a second end; a plurality of removable disks in the tube, moveable within the tube, wherein space between two adjacent disks within the tube is hermetically sealed for holding one of said contact lenses therein; and an advancement mechanism urging the disks toward the first end of the tube.

In another aspect, a device for dispensing contact lens includes a holder. The holder includes a container having an end opening, a floor, and a wall extending from the floor to the end opening to define a cavity sized to receive a plurality of removable disks in the cavity; and a removable cap at the end opening and, in combination with the wall, providing a hermetic seal to the cavity; and an advancement mechanism urging the removable disks toward the first end of the tube, the first end of the tube adjacent the end opening of the holder upon insertion of the cartridge into the holder. The holder may be designed to receive a cartridge containing the removable disks.

III. BRIEF DESCRIPTION OF THE DRAWINGS

The foregoing and other features and advantages of the invention will be apparent from the following, more particular description of preferred embodiments of the invention, as illustrated in the accompanying drawings.

IV. DETAILED DESCRIPTION

Figure 1:
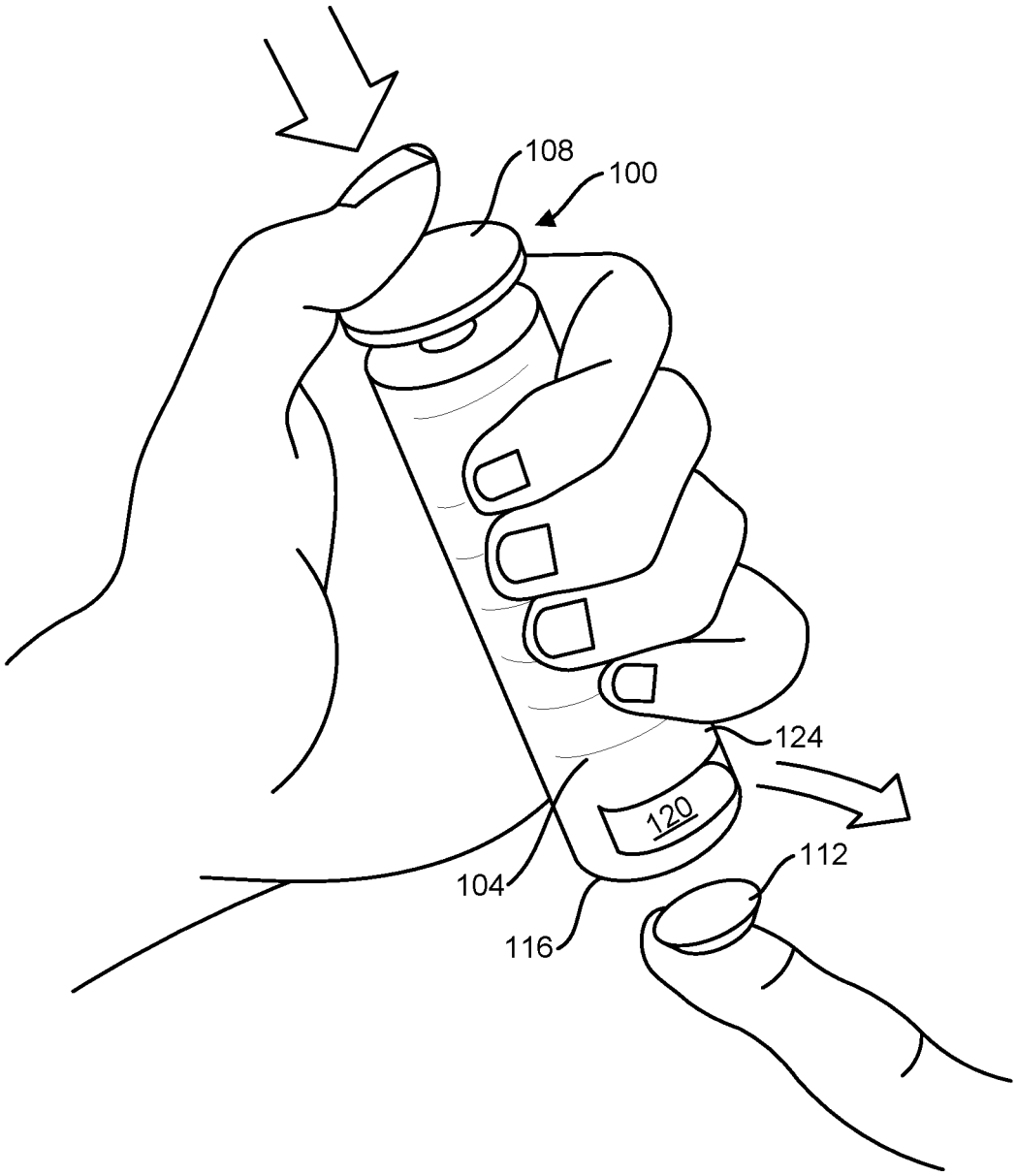
FIG. 1 illustrates an example of a contact lens dispensing device according to principles described herein.

Reference will now be made in detail to representative embodiments illustrated in the accompanying drawings wherein reference numerals indicate certain elements. The following descriptions are not intended to limit the myriad embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, aspect, or characteristic, but every embodiment may not necessarily include the particular feature, structure, or characteristic. Moreover, such phrases are not necessarily referring to the same embodiment. Further, when a particular feature, structure, aspect, or characteristic is described in connection with an embodiment, it is submitted that it is within the knowledge of one skilled in the art to effect such feature, structure, or characteristic in connection with other embodiments whether or not explicitly described.

As used herein, the following terms have the following meaning. A benefit of the certain embodiments the present invention is that they facilitate consistent single-touch lens transfer from the package to a wearer's finger, and then from the finger to the wearer's eye without the lens inverting, falling off the finger or further manipulation.

Lens(es) or contact lens(es) refer to ophthalmic devices that reside on the eye. They have a generally hemispheric shape and can provide optical correction, cosmetic enhancement, UV blocking and visible light or glare reduction, therapeutic effect, including wound healing, delivery of drugs or neutraceuticals, diagnostic evaluation or monitoring, or any combination thereof. The term lens includes soft hydrogel contact lenses, which are generally provided to the consumer in a package in the hydrated state, and have a relatively low moduli, which allows them to conform to the cornea. Contact lenses suitable for use with the packages of the present invention include all hydrated contact lenses, including conventional and silicone hydrogel contact lenses.

A hydrogel is a hydrated crosslinked polymeric system that contains water in an equilibrium state, and may contain at least about 25%, or at least 35% water in the hydrated state. Hydrogels typically are oxygen permeable and biocompatible, making them excellent materials for producing contact lenses.

Conventional hydrogel contact lenses do not contain silicone containing components, and generally have higher water content, lower oxygen permeability, moduli, and shape memories than silicone hydrogels. Conventional hydrogels are prepared from monomeric mixtures predominantly containing hydrophilic monomers, such as 2-hydroxyethyl methacrylate ("HEMA"), N-vinyl pyrrolidone ("NVP") or polyvinyl alcohols. U.S. Pat. Nos. 4,495,313, 4,889,664 and 5,039,459 disclose the formation of conventional hydrogels. Conventional hydrogels may be ionic or non-ionic and include polymacon, etafilcon, nelfilcon, ocufilcon lenefilcon and the like. The oxygen permeability of these conventional hydrogel materials is typically below 20-30 barrers.

Silicon hydrogel formulations include balafilcon samfilcon, lotrafilcon A and B, delfilcon, galyfilcon, senofilcon A, B and C, narafilcon, comfilcon, formofilcon, riofilcon, fanfilcon, stenfilcon, somofilcon, kalifilcon and the like. "Silicone hydrogels" refer to polymeric networks made from at least one hydrophilic component and at least one silicone-containing component. Silicone hydrogels may have moduli in the range of 60-200, 60-150 or 80-130 psi, water contents in the range of 20 to 60%. Examples of silicone hydrogels include acquafilcon, asmofilcon, balafilcon, comfilcon, delefilcon, enfilcon, fanfilcon, formofilcon, galyfilcon, lotrafilcon, narafilcon, riofilcon, samfilcon, senofilcon, somofilcon, and stenfilcon, verofilcon, including all of their variants, as well as silicone hydrogels as prepared in U.S. Pat. Nos. 4,659,782, 4,659,783, 5,244,981, 5,314,960, 5,331,067, 5,371,147, 5,998,498, 6,087,415, 5,760,100, 5,776,999, 5,789,461, 5,849,811, 5,965,631, 6,367,929, 6,822,016, 6,867,245, 6,943,203, 7,247,692, 7,249,848, 7,553,880, 7,666,921, 7,786,185, 7,956,131, 8,022,158, 8,273,802, 8,399,538, 8,470,906, 8,450,387, 8,487,058, 8,507,577, 8,637,621, 8,703,891, 8,937,110, 8,937,111, 8,940,812, 9,056,878, 9,057,821, 9,125,808, 9,140,825, 9,156,934, 9,170,349, 9,244,196, 9,244,197, 9,260,544, 9,297,928, 9,297,929 as well as WO 03/22321, WO 2008/061992, and US 2010/0048847. These patents are hereby incorporated by reference in their entireties. Silicone hydrogels may have higher shape memory than conventional contact lenses.

Hydrogel lenses are viscoelastic materials. Contact lenses can form optical distortions if the lens interacts with either the package or any air bubble in the package. The extent of the optical distortions, and the length of time needed for the distortions to relax out will vary depending on the chemistry, and to a lesser extent, geometry of the lens. Conventional lens materials, such as polyhydroxyethyl methacrylate-based lenses like etafilcon A or polymacon have low loss modulus and tan delta compared to silicone hydrogels and may form fewer and less severe optical distortions as a result of contact with packaging. The incorporation of silicones (which generally increase the bulk elastic response), wetting agents such as PVP (which generally increase the viscous response) or coatings of conventional hydrogel materials (which may lower the elastic response at the lens interface) can alter the lens viscoelastic properties. Conventional hydrogel contact lenses and silicone hydrogel contact lenses having short or stiff crosslinking agents and or stiffening agent have short shape memories and may be less susceptible to deformation during storage. As used herein, high or higher shape memory hydrogels display optical distortions from contact with an air bubble or package of at least about 0.18 after 5 weeks of accelerated aging at 55° C. Viscoelastic properties, including loss modulus and tan delta, can be measured using a dynamic mechanical analysis.

The contact lenses can be of any geometry or power, and have a generally hemispherical shape, with a concave posterior side which rests against the eye when in use and a convex anterior side which faces away from the eye and is contacted by the eyelid during blinking.

The center or apex of the lens is the center of the lens optic zone. The optic zone provides optical correction and may have a diameter between about 7 mm and about 10 mm. The lens periphery or lens edge is the edge where the anterior and posterior sides meet.

"Film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

A "wearer" or "user" as used herein refers to a person opening a contact lens package. The user is generally referred to as the person who both opens the package and transfers the contact lens contained therein to their eye. However, the user in some contexts may be a person handling the lens package on behalf of the wearer, such an eye care provider ("ECP") or another individual demonstrating for or assisting the wearer.

Packaging solution is any physiologically compatible solution, which is compatible with the selected lens material and packaging. Packaging solutions include buffered solutions having a physiological pH, such as buffered saline solutions. The packaging solution may contain known components, including buffers, pH and tonicity adjusting agents, lubricants, wetting agents, nutraceuticals, pharmaceuticals, in package coating components and the like.

References throughout this description to injection molding processes and the use of materials conventionally applied to injection molding should be understood as exemplary. Those of skill in the art will appreciate that other means of manufacture are possible within the scope of the appended claims, including but not limited to alternative molding processes, thermoforming, 3D printing, and the like. Likewise, references to heat seals and heat sealing are exemplary to embodiments described herein. Other means of securing packaging components will be apparent to those skilled in the art, including the use of adhesive, glue, thermal bonding, welding such as heat, ultrasonic or laser welding, or a mechanical trap, and the like.

According to principles described herein, a new contact lens dispenser with a one-touch contact lens handling capabilities houses a plurality of contact lenses in individual pods or partitions, each of which in turn contains a sterile packaging solution to keep the contact lens hydrated. The contact lens dispenser is equipped with an actuator that allows a contact lens to be dispensed out of its pod onto a fingertip ready for insertion in the eye. As described in detail herein, the "pod" may be an individual sealed packaging element or partition or may be a volume defined by adjacent structures, such as a disk, or separator.

According to principles described herein, a contact lens dispensing device that facilitates one touch application of a contact lens to a wearer's eye may include a tube (or other elongate shape with a cavity extending therethrough) that is designed to hold a plurality of contact lenses in the tube. The contact lenses are held in the tube separated from each other by a removable disk, puck or other hermetic separator or partition, or contact lens package. For the sake of convenience, the term disk is used throughout to describe the structures movable within a tube according to principles described herein, although it should be appreciated that the structures are not limited to having a curved or circular profile. In addition, the term "tube" is used throughout the specification for the sake of convenience, although the structures are not limited to being curved or circular in profile.

In accordance with the principles described herein, the disks or pods are moveable within the tube, and the contact lens is held in solution in a pod or removable partition or between two adjacent disks. The disks or removable partitions are advanced within the tube via an advancement mechanism, to be further described herein. Without limitation, for example, the advancement mechanism may be a spring-loaded device, ratchet, helical thread or the like, that urges the disks toward an end of the tube when actuated by a user.

FIG. 1 illustrates an exemplary embodiment of a contact lens dispensing device according to principles described herein. As shown in FIG. 1, the contact lens dispenser 100 comprises a body/cylinder 104 having a lumen with a depressible plunger 108 for advancing and releasing a contact lens 112 to a user. While shown as a cylinder, it should be appreciated that the actual form of the dispenser is not so limited and can be of any cross-section within the principles described herein. The cylinder 104 may include more than one opening. In the illustrated embodiment, a first opening 116 (also referred to herein as "end" and "end opening") (see FIGS. 2A-C) of the cylinder 104 releases the contact lens, while a second opening 120 through the cylinder's side wall 124 allows for removal of the removable disk, pod, or partition (see FIG. 1) from the cylinder 100. The plunger 108, when depressed by the user, advances the removable pod within the cylinder, and causes release of the contact lens 112 through the end 116 of the cylinder 100. The actuation mechanism of the plunger 108 may be a spring, such as a tensile spring, ratchet, helical thread, or other appropriate or known advancement mechanism without limitation. While described herein as being cylindrical, the dispenser is not so limited and may be of any elongated shape with a lumen therethrough or cavity therein appropriate for holding the removable pods therein and allowing those removable pods to be advanced within the lumen for releasing a contact lens and removing the removable pod.

Figure 2A:
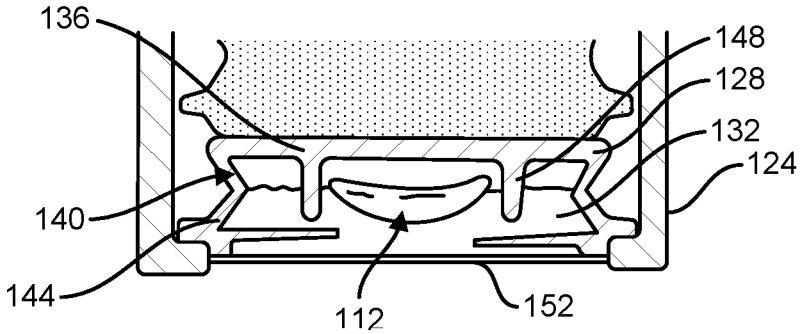
FIGS. 2A-2C illustrate dispensing a contact lens from the dispensing device of FIG. 1 according to principles described herein.
Figure 2B:
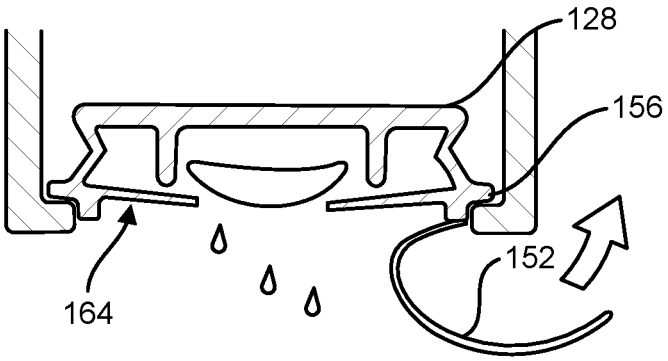
Figure 2C:
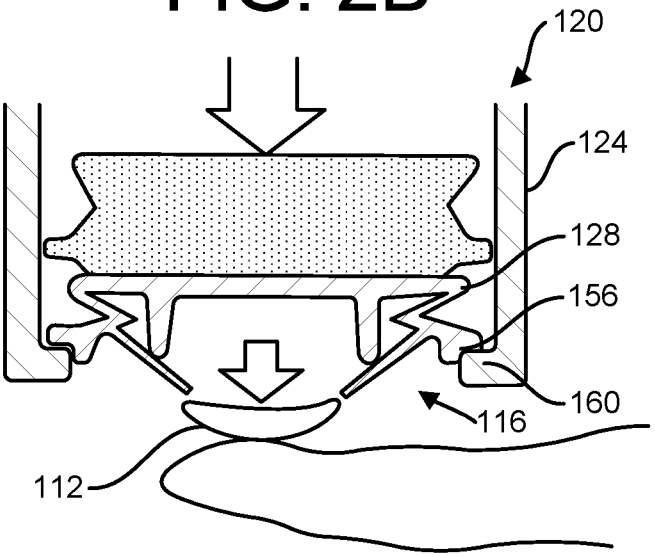

FIGS. 2A-2C illustrate release of a contact lens 112 and removal of the removable pod 128.

As can be seen in FIG. 2A, a contact lens 112 is held in solution 132 within a cavity defined by the removable pod 128. The removable pod 128 includes a base 136, a peripheral wall or protrusion 140 extending away from the base 136 to form a wall of the cavity that holds the contact lens 112. In an aspect, the peripheral wall 140 may be a protrusion, provided that a cavity for holding the contact lens 112 in solution is provided with a hermetic seal as described herein with respect to FIGS. 1 and 2A-2C.

The peripheral wall 140 is spaced apart from a center of the base 136 by a first distance. An edge or rim 144 of the peripheral wall 140 is spaced a first length from the base sufficient to form the wall of the cavity holding the contact lens 112. The removable pod 128 includes at least one additional protrusion 148. The additional protrusion 148 extends from the base in a position between the first wall 140 and the contact lens 112 and is shorter than the peripheral wall 140. A hermetic seal 152 covers an expanse formed by the edge or rim 144 of the peripheral wall 140, thereby forming a hermetically sealed volume. The peripheral wall 140 is collapsible such that it can be compressed or collapsed so that the base 136 moves from a first position to a second position, causing an end of the additional protrusion 148 to move from a first position to a second position.

Referring to FIG. 2B, the removable pod 128 may further include a support rim or protrusion 156 adjacent the edge or rim 144 of the peripheral wall 140, the support rim or protrusion 156 may extend in a direction non-parallel to the peripheral protrusion. The cylinder 100 may include a flange 160 adjacent the end opening 116 that abuts the support rim/protrusion 156 to prevent the removable pod 128 from being pushed through the end opening 116. That is, diameter or width of the end opening 116 with flange 160 is less than the diameter or width of the removable partition 128 at the support rim/protrusion 156.

Given that the peripheral wall 140 is collapsible, upon advancing the removable pod 128 toward the end of the tube having the opening 116, the flange 160 in cooperation with the support rim/protrusion 156 prevents the removable pod 128 from advancing any further. Thus, force provided by the advancement mechanism causes collapse of the peripheral wall 140, whereby the base and the additional protrusion 148 continues to advance toward the end of the tube. In an aspect, the additional protrusion 148, in moving from the first position to the second position, can pierce or break the hermetic seal covering the cavity, allowing for release of the contact lens from the cavity, for example, released by gravity through the opening 116 to the user. In such case, the additional protrusion 148 should have sufficient rigidity and the hermetic seal sufficient frangibility to allow for the additional protrusion to break the hermetic seal 152. The additional protrusion 148 may include an end geometry or element, such as a point, to facilitate piercing, breaking, or dislodging the hermetic seal.

In another aspect, the removable pod 128 may further include a swing arm 164, or two swing arms, extending from an edge of the peripheral wall 140 in a direction non-parallel to the peripheral wall 140. At least a portion of the swing arm may overlap an end of the additional protrusion 148 such that when the advancement mechanism urges the removable pod 128 toward the end of the tube and the flange 160 arrests advancement of the removable partition 128 and the peripheral protrusion collapses, the additional protrusion 148, moving from the first position to the second protrusion abuts and moves the swing arm 164, which in turn pivots from a fulcrum, in FIG. 2, adjacent the flange 160, to pierce or dislodge the hermetic seal 152. The swing arm 164 may include a geometry or element, such as a point, to facilitate piercing, breaking, or dislodging the hermetic seal.

Continued advancement of the swing arm 164 may cause the hermetic seal 152 to move out of the path of the contact lens 112, which is then released by gravity through the opening 116 to the user. Ends of the swing arm(s) should have relatively low contact surface area it interact with the lens (e.g., less than about 10 mm) to prevent the lens sticking to the swing arms. In such an aspect, the additional protrusion 148 should have sufficient rigidity to move the swing arm 164, the swing arm 164 should have sufficient flexibility or be sufficiently hinged to move with the movement of the additional protrusion 148, but sufficient rigidity at the end of the swing arm 164 to pierce or dislodge the hermetic seal 152. In alternative embodiments, an additional protrusions such as additional protrusion 148 may not be necessary, for example, where support protrusions 156 are sufficiently long to provide a rotating force and are coupled to swing arts so that the walls of the pack twist instead of the crushing action shown in the example depicted.

In the above-described aspects, the hermetic seal 152 may be made of any suitable frangible material suitable for packaging medical devices, including a molded sheet of foil or plastic, laminate films, or plastic. Multilayer films used in conventional contact lens packages may be used, a component of the hermetic seal. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

While described above as protrusions, the additional protrusion(s) 148 may be a circumferential or peripheral flange extending completely or partly around a diameter within the peripheral wall 140. Similarly, the swing arm 164 may be a circumferential or peripheral flange around a diameter within the peripheral wall 140.

Removal of the removable pod 128 is performed after the release of the contact lens by tilting or otherwise pulling the removable pod 128 through the opening 120 in the wall 124 of the cylinder 100, as illustrated in FIG. 1.

Figure 3A:
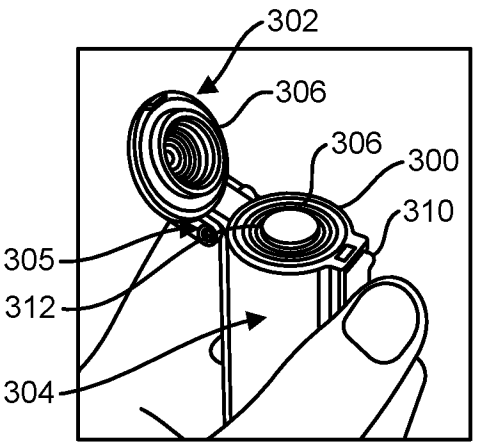
FIGS. 3A-3D illustrate another example of a contact lens dispensing device according to principles described herein.

FIGS. 3A-3D illustrate use of another embodiment of the present invention. FIG. 3A illustrates contact lens dispensing system 300 comprising a body 304 with a plurality of removable disks 306 therein. As can be seen in FIG. 3A, the system includes a lid 302 which may be connected with the body, e.g., via a hinge 305, or may be completely or partially removable from the body 304. As will be described later, the lid 302 may be configured to lift an uppermost of the removable disks 306 to expose a contact lens 312 on an upper dome of the next removable disk in sequence. FIG. 3A shows two of the removable disks, one 306*a* which is held by the lid 302 and one 306*b* on which contact lens 312 is positioned. The system further includes a latch 310 which can be used to hold the lid in a position to close an end 314 of the cylinder 300. The engagement of the latch illustrated is pawl/catch and detent, which will be described in further detail herein, but any appropriate latch may be used in the system without departing from the spirit and scope of the invention. The removable disk 306 may be held in place in the lid by a catch, rim, or flange until removed or ejected. The lid 302 may further include a plunger (not shown) in communication with a button 318 for ejecting the removable disk 306*a* from the lid 302.

Figure 3B:
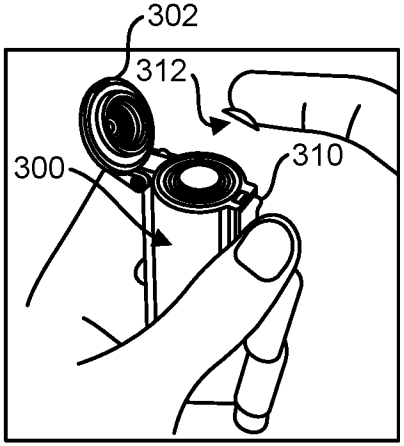
Figure 3C:
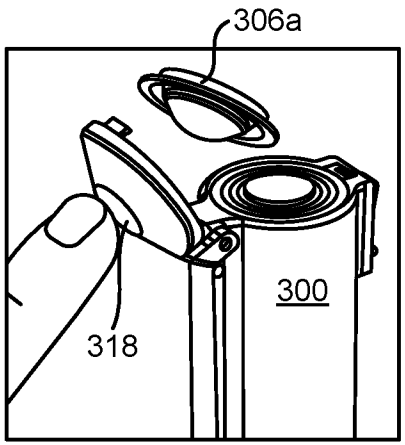
Figure 3D:
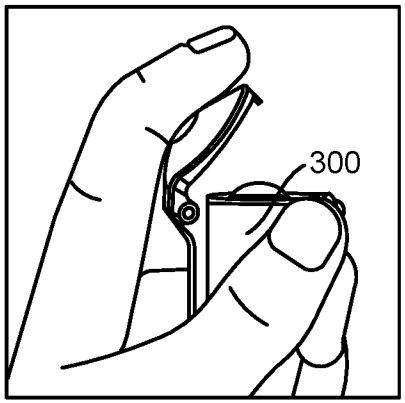

In operation, as seen in FIG. 3A, a user depresses or otherwise activates the latch 310 to open the lid 302. The uppermost of the removable disks 306*a* is held by the lid 302, e.g., by a rim, flange, or catch, such that upon opening of the lid 302, the uppermost disk 306*a* is withdrawn from the top of a stack of removable disks to expose the contact lens 312 on the now uppermost disk 306*b* in the lumen of the tube or cylinder 300. As seen in FIG. 3B, the user may then dab the surface of the contact lens 312, in this case the apex of the convex side of the lens 312, which is held to the user's finger by surface tension, to remove the contact lens 312 from the now uppermost removable disk 306*b*. The user may then insert the contact lens 312 in his/her eye (not shown). As seen in FIG. 3C, the previously uppermost disk 306*a* that is now held by the lid 302 may be ejected by depressing the button 318 to mechanically depress a plunger (not shown) to disengage the removable disk 306*a* from the lid to be disposed of. As shown in FIG. 3D, the user may then close the lid 302 onto the end of the cylinder 300, thereby holding the now uppermost disk in place for later access and removal to expose the next contact lens in sequence. As will be described in detail later, upon closing the lid 302, the uppermost removable disk may engage structures in the lid 302 whereby the uppermost removable disk will move with the lid 302 when the lid 302 is next opened. As illustrated in FIGS. 3A-3B, the lid 302 may be connected to the dispenser body.

The lid 302 may include a recess in a periphery of its interior such that a flange of one a topmost of the removable disks is caused to be received in the recess by force of the actuation mechanism. The device may include a catch to hold the removable disks in tension against the advancement mechanism until the catch is released. The catch is releasable by actuation of a button such that actuation of the-button causes one of the removable disks adjacent the end opening to advance out of the end opening.

Figure 4B:
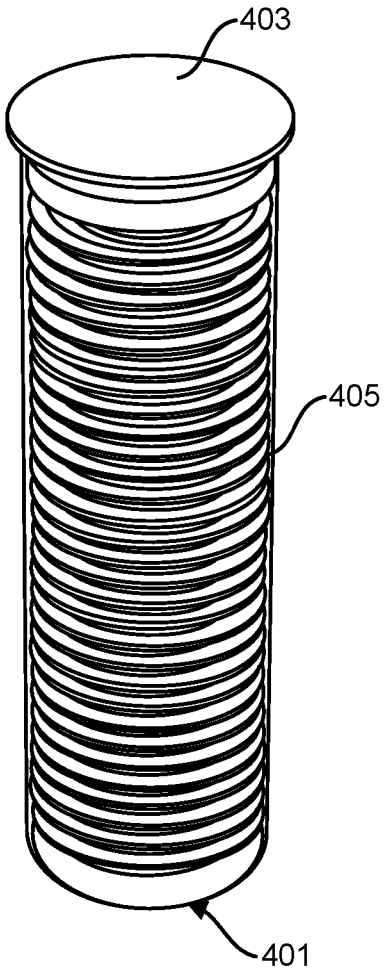
FIGS. 4A and 4B illustrate features of a contact lens dispensing device according to principles described herein.
Figure 4A:
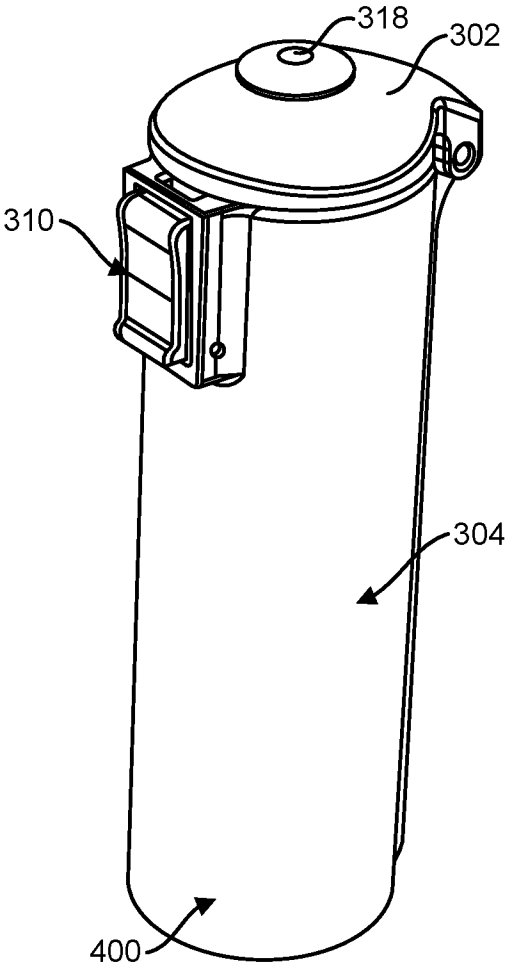

In an aspect of the present disclosure, the removable disks and contact lenses thereon may be loaded directly into the lid/cylinder mechanism as previously described or, as illustrated in FIGS. 4A and 4B, the system may comprise a holder 400 and a cartridge 401 that is preloaded with multiple removable disks with contact lenses in solution therebetween. Regardless of whether the removable disks are loaded directly into the dispenser or into a cartridge, the principles described herein with respect to the configuration of the removable disks and their loading and interactions with contact lenses within a tube continue to apply. As can be seen in FIG. 4B, a film, such as foil, or lid may be applied to the end of the cartridge 401 over the topmost contact lens in the cartridge 401. Although not shown, a directly loaded dispenser may include a film, such as foil, or lid over the topmost contact lens in the directly loaded dispenser. The lid may comprise any material appropriate for covering a contact lens, and described previously herein, for example, "film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

Figure 5:
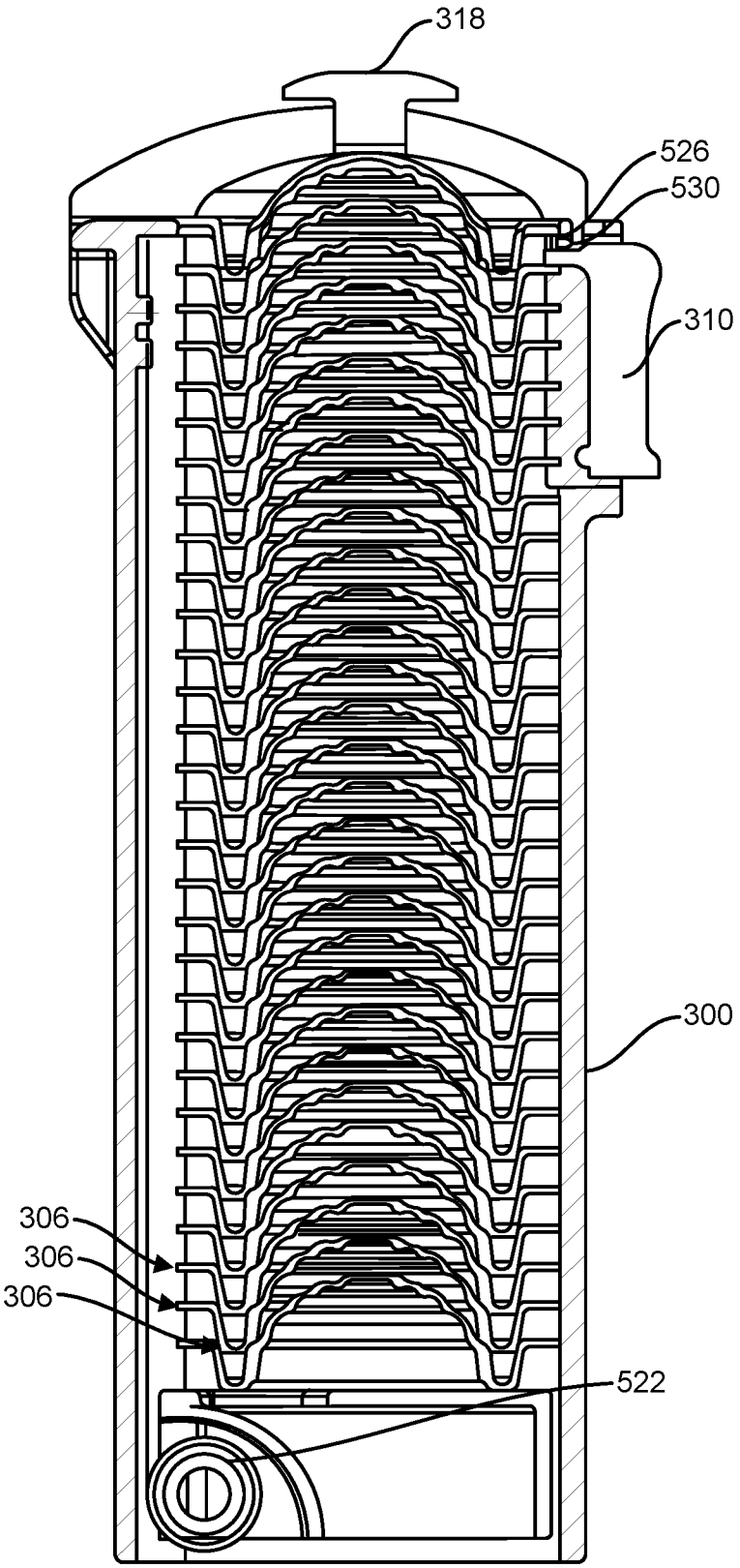
FIG. 5 illustrates contact lenses in storage in the contact lens dispensing device illustrated in FIG. 3A-3D.

Referring now to FIG. 5, which illustrates the removable disks 306 in a dispenser 300, the dispenser 300 includes an actuation mechanism, such as a spring 522, e.g. a tensile spring or the like. In the illustrated embodiment, the tensile spring 522 provides a relatively constant force urging the removable disks 306 up from the bottom of the dispenser 300 toward the lid 302. The spring pushes the removable disks 306 up from the bottom of the tube or cavity of the cylinder/dispenser 300. In an aspect, actuation of the latch 310 dislodges the topmost removable disks 306 causing it to be held in the lid 302 by structures in the lid. The lid or cap 302 seals the topmost lens using the last used removable disk 306. In another aspect, the topmost disk may be dislodged by opening of the cap or lid in the event that the topmost disk is held in the lid by the structures in the lid before opening of the lid.

Looking to the latch 310 of FIG. 5, depressing of the latch disengages a pawl 526 from a detent 530 in the lid 302, which in turn causes the topmost removable disk 306 to engage with the lid 302 to be removed with the lid 302.

Figure 6:
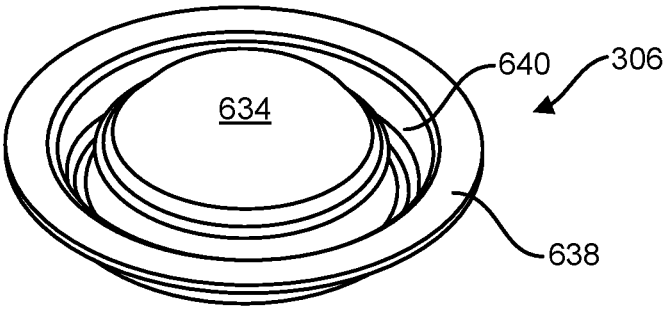
FIG. 6 illustrates an example removable disk of the contact lens dispensing device of FIGS. 3A-3D, 4A and 4B, or 5.
Figure 7:
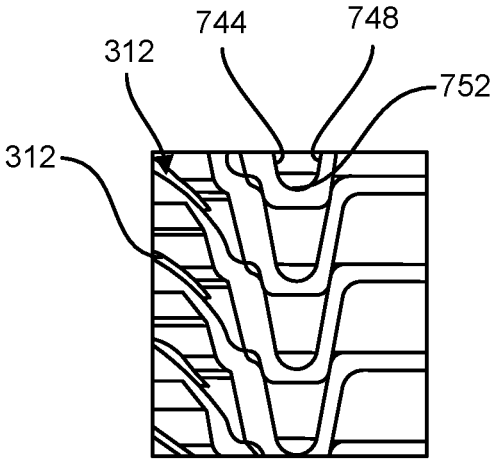
FIG. 7 illustrates details of adjacent disks in the dispensing device of FIGS. 3A-3D, 4A and 4B, or 5.

As can be seen in FIG. 6, each removable disk 306 includes a central dome 634 surrounded by a flexible flange 638. The flexible flange 638, when a lumen or cavity of the dispenser 300 or cartridge 401, forms an interference fit with the lumen wall. The flexible flange 638 may be separated from the central dome 634 by a channel 640. The channel 640 may be u-shaped, but in any event comprises an interior wall 744, an exterior wall 748 and a floor 752, best seen in FIG. 7. An underside of the interior wall of the uppermost removable disk 306 abuts an upper side of the interior wall of the next lower removable disk 306, and so on in the stack of removable disks remaining in the dispenser or cartridge. The abutment is held in place by the force of the spring 522 onto the underside of the bottommost removable disk 306. The abutment of two disks together creates a hermetically sealed space between the top side of the central dome of the lower disk and an underside of the central dome of the removable disk above it. The central dome is sized to hold thereon a contact lens. With sterile solution held in the hermetically sealed space and a contact lens on the central dome in the hermetically sealed space, the contact lens can be held within the dispenser in a sterile environment until ready to be dispensed as described above. The abutment of the two adjacent disks may include an interference fit between underside of the upper disk's interior wall and the top side of the lower disk's interior wall, as shown in FIG. 7. The fit between adjacent disks may be enhanced by tapering or angling of the interior wall with respect to the inner wall of the lumen of the dispenser/cartridge. Such tapering or angling may provide a luer lock between the inner walls of two adjacent disks. For example, each interior wall of a removable disk may be at an angle of about 10 degrees with respect to the wall of the tube of the dispenser/cartridge. In an aspect, the underside of an upper disk's exterior wall may abut an upper side of the lower disk's exterior wall. A hermetically sealed volume may be formed by the bottom wall of an upper disk, the interior wall of the bottom disk, the external wall of the bottom disk and the bottom wall of the bottom adjacent disk, i.e., in the channel of the lower disk.

Further, the exterior walls of the disks may be tapered or angled sufficient to form a luer lock when abutting. For example tapering or angling of the exterior wall with respect to the inner wall of the lumen of the dispenser/cartridge. Such tapering or angling may provide a luer lock between the exterior walls of two adjacent disks. For example, each exterior wall of a removable disk may be at an angle of about 10 degrees with respect to the wall of the tube of the dispenser/cartridge.

In any of the embodiments described herein, the removable disks or partitions with the contact lens stored therebetween or therein may be provided in a cartridge, such as the one shown in FIG. 4B, in which the contact lens and the related disks/packages are stacked within the cartridge. The cartridge may be a tube, for example, cylindrical or other form, with a lumen therethrough, sized to receive the various configurations of the contact lens, removable disks or packages therein. The loaded cartridge can then be slid into a lumen of a complementary dispenser, such as the dispenser 100 illustrated in FIG. 1 or the dispenser 400 of FIG. 4A. In the illustrated embodiment, the cartridge of FIG. 4B a predetermined number of removable disks as shown in FIGS. 5, 6 and 7 are preloaded as they are shown in FIG. 5 with a contact lens between each disk to be removed according to the operations shown in FIGS. 3A-3D. As shown in FIG. 4B, if the cartridge does not contain individual packages, as in the dispenser of FIGS. 1 and 2, but instead has removable disks with a contact lens in a space therebetween formed by a cavity defined by two of the removable disks, a lid 403 may be placed over the topmost disk (which may have a contact lens thereon or may be a "blank" disk or other topmost covering) in the stack in the cartridge such that upon insertion into the holder 400 comprising the body 304 and lid 302, the user may remove the lid 403 to reveal a topmost contact lens or a topmost disk/covering. The lid 403 itself may comprise any material that provides a hermetic seal in conjunction with a rim of the cartridge wall 405, such as are films used to seal the package and are often referred to as lidstock. The lid 405 may be made from any material suitable for packaging medical devices, including a molded sheet of foil or plastic, laminate films, or plastic. Such multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

The cartridge wall 405 may be of any material suitable for packaging medical devices, including plastic. The packaging lid generally resides at the upper portion the package and seals with the cartridge 405 to form a cavity or lumen housing the removable disks, lens, and packaging solution. Packages comprising plastic for one structure and foil or laminated films as the other, or packages comprising foil or laminated films as the outer layer for the lid and base are known in the art and are examples of suitable combinations.

Although not shown, the cartridge 401 of FIG. 4B further includes a movable structure that when acted upon by the spring 522 of the holder 400 causes the removable disks to advance upward toward the opening of the lumen of the cartridge such that the topmost disk is available at the end of the cartridge and holder for access by the user, so that the user may dab and remove the contact lens on the topmost disk. The movable structure may include a foil or plastic such that sterile nature of the interior of the cartridge is maintained. In an aspect, the sterile nature of the contact lens within the cartridge may be maintained, for example, by a bottommost removable disk, movable within the cartridge and movable within the cartridge, while maintaining a hermetic seal such that solution within the cartridge and/or within the cavity housing the contact lens formed by the bottommost disk is maintained.

Thus, in an exemplary embodiment, a contact lens dispensing device for dispensing one contact lens of a plurality of contact lenses, the device comprising includes a tube having a first end and a second end. There are a plurality of removable disks in the tube. The removable disks are moveable within the tube and space between the two adjacent disks within the tube is hermetically sealed for holding a contact lens. The dispensing device includes an advancement mechanism urging the disks toward the first end of the tube. The removable disk may be disposable.

In an aspect, the removable disk includes a central dome surrounded by a flexible flange. The flange forms an interference fit with a wall of a lumen of the tube.

The flexible flange of each removable disk may be separated from a periphery of the central dome by a u-shaped channel 640. The u-shaped channel of each removable disk may include an interior wall, an exterior wall, and a floor. In an aspect, the interior wall of a first removable disk abuts an upper side of the interior wall of a second removable disk. The abutment of the interior wall of the first one of the two adjacent disks and the interior wall of the second one of the two adjacent disks may provide a hermetic seal for the space between the two adjacent disks. The abutment between the interior wall of the first adjacent disk and the interior wall of the second adjacent disk may be by an interference fit. The channel may also act as a catch for solution stored in each pack. For example, as illustrated, the channel is situated at a lower level than the lens within the disk thus allowing the lens to fully drain once the pod is opened.

A taper of each interior wall with respect to a wall of the tube may be sufficient to provide a luer lock between two adjacent interior walls. The interior wall of each adjacent disk may be at an angle of about 10 degrees with respect to a wall of the tube. In an aspect, an underside of an external wall of a first adjacent disk may abut an upper side of external wall of a second adjacent disk.

A hermetically sealed volume may be defined by the bottom wall of the first adjacent disk, the interior wall of the second adjacent disk, the external wall of the second adjacent disk and the bottom wall of the second adjacent disk. In an aspect, a taper of each external wall with respect to a wall of the tube may be sufficient to provide a luer lock between two adjacent external walls. The external wall of each adjacent disk may be at an angle of about 10 degrees with respect to a wall of the tube. In general, the central dome is sized to receive said contact lens thereon. Each disk further may include a wall between the central dome and the flexible flange. The wall may have a height greater than the central dome to space the disk from an adjacent disk and hermetically seal a space between the central dome, the wall, and a disk adjacent an upper side of the central dome.

Each disk may also include a wall extending from a surface of the disk opposite the apex of the central dome between a rim of the central dome and the flexible flange. This wall may have a height greater than the central dome to space the disk from an adjacent disk in the tube and hermetically seal a space between the wall, the underside of the disk and a central dome of an adjacent disk.

The dispenser may further include an actuator mechanism to cause the advancement mechanism to eject a top-most one of said disks from the first end of the tube thereby presenting one of said contact lenses at the first end of the tube.

The contact lens dispensing device may include a lid sized to hermetically seal the first end of the tube. The lid may be hinged or pivotally connected to the first end of the tube. The device may include a latch mechanism for securing the lid to the tube. The latch mechanism may include an actuator mechanism causing the advancement mechanism to eject a topmost one of said disks from the first end of the tube thereby presenting one of said contact lenses at the first end of the tube. The latch may include a tooth and a complementary recess, such that the cap is fastened to the container when the tooth is seated in the complementary recess. The latch may be actuatable by a button to unseat the tooth from the complementary recess.

The dispensing device may include a holder comprising a container having an end opening, a floor, and a wall extending from the floor to the end opening to define a cavity; and a removable cap at the end opening and, in combination with the wall, providing a hermetic seal to the cavity; and an advancement mechanism urging the disks toward the first end of the tube, the first end of the tube adjacent the end opening of the holder upon insertion of the cartridge into the holder. For example, the advancement mechanism may be a spring in the cavity. The spring may be, for example, a tensile spring at a bottom of the cavity. The spring may be, for example, a coil spring at the bottom of the cavity biased toward the end opening.

The device may further include a cartridge insertable into the holder between the floor and the end opening. The cartridge may include a tube having a cross-sectional profile smaller than a cross-sectional profile of the container and having a first end and a second end. The plurality of removable disks may be housed in and movable within the tube such that space between two adjacent disks within the tube is hermetically sealed for holding a contact lens. The container/dispenser may include a catch to hold the removable disks in tension against the advancement mechanism until the catch is released. The device may include a catch to hold the removable disks in tension against the advancement mechanism until the catch is released. The catch is releasable by actuation of a button such that actuation of the button causes one of the removable disks adjacent the end opening to advance out of the end opening.

The lid may include recess in a periphery of its interior such that a flange of one a topmost of the removable disks is caused to be received in the recess by force, such as a bias force, of the actuation mechanism. There may be a depressible plunger extending through the replaceable cap from an exterior surface of the replaceable cap to adjacent an interior of the removable cap. Depression of the plunger from the exterior side of the replaceable cap may cause deflection of a portion of the interior surface of the replaceable cap to displace the removable disk In another aspect, the removable disk may include at least one peripheral protrusion having a first height and extending from a first surface of the disk, the peripheral protrusion spaced apart from a center of the disk by a first distance and having an edge spaced a first length from the first surface and another protrusion having a second height and extending from the first surface and spaced from the center of the removable disk by a second distance, wherein the second distance is less than the first distance; and a hermetic seal covering an expanse formed by the edge of the peripheral protrusion, thereby forming a hermetically sealed volume. The peripheral protrusion may be collapsible from the first height to a third height less than the second height such that the rigid protrusion breaks the hermetic seal upon collapse of the peripheral protrusion from the first height to the third height. The hermetically sealed volume holding a contact lens may be defined by the peripheral protrusion, the rigid protrusion, and the hermetic seal. The contact lens may thus be held in solution in the hermetically sealed volume. The peripheral protrusion may include a flexible material and/or may include a hinge to aid in the collapsibility. For example, the hinge may be a living hinge. There may be support rim around the edge of the peripheral protrusion, which may include a projection extending in a direction non-parallel to the peripheral protrusion. The device may also include a rib adjacent a radial region of the hermetic seal and extending in a direction non-parallel to the hermetic seal and away from the peripheral protrusion.

The removable disk may also include at least one swing arm extending from the edge of the peripheral protrusion to a position adjacent an end of the at least one rigid protrusion. There may also be a ridge along an inside wall of the tube at the opening and configured to arrest movement of the removable disk such that the peripheral protrusion is compressed upon application of a force in the axial direction of the tube toward the second end of the tube.

There may also be a depressible plunger adjacent the cap or lid at the first end of the tube operably connected to the lumen of the tube to urge at least one of the removable disks toward the second end of the tube. Upon depression of the plunger, the at least one of said removable disks is urged toward the second end of the tube, causing the peripheral protrusion to compress, causing the rigid protrusion to advance toward the hermetic seal and cause the hermetic seal to break. The depressible plunger may be biased away from the lumen of the tube. The depressible plunger may include a push button. The depressible plunger may be a button and a stem biased away from the first opening of the tube. There may also be slot or opening in a wall of the tube or container whereby the removable disk is removable from the tube through the slot.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not targeted to be exhaustive or to limit the embodiments to the precise forms disclosed. It will be apparent to one of ordinary skill in the art that many modifications and variations are possible in view of the above teachings.

The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The packages of the present invention may be manufactured using known materials and processes. The packaging materials may be virgin, recycled or a combination thereof. The volume within the package cavity can vary depending on the design selected.

Exemplary aspects of examples of the invention are further described by the following clauses:

1. A contact lens dispensing device for dispensing one contact lens of a plurality of contact lenses, the device comprising:
   a tube having a first end and a second end;
   a plurality of removable disks in the tube, moveable within the tube, wherein space between two adjacent disks within the tube is hermetically sealed for holding one of said contact lenses therein; and
   an advancement mechanism urging the disks toward the first end of the tube.
2. The contact lens dispensing device of clause 1, wherein the removable disk is disposable.
3. The contact lens dispensing device of clause 1, wherein each removable disk comprises:
   a central dome surrounded by a flexible flange, the flange forming an interference fit with a wall of a lumen of the tube.
4. The contact lens dispensing device of clause 3, wherein the flexible flange of each removable disk is separated from a periphery of the central dome by a u-shaped channel.
5. The contact lens dispensing device of clause 4, wherein the u-shaped channel of each removable disk comprises an interior wall, an exterior wall, and a floor.
6. The contact lens dispensing device of clause 5, wherein an underside of the interior wall of a first removable disk abuts an upper side of the interior wall of a second removable disk.
7. The contact lens dispensing device of clause 6, wherein the abutment of the interior wall of the first one of the two adjacent disks and the interior wall of the second one of the two adjacent disks provides a hermetic seal for the space between the two adjacent disks.
8. The contact lens dispensing device of clause 6 or 7, wherein the abutment between the interior wall of the first adjacent disk and the interior wall of the second adjacent disk includes an interference fit.
9. The contact lens dispensing device of any of clauses 5-8, wherein a taper of each interior wall with respect to a wall of the tube is sufficient to provide a luer lock between two adjacent interior walls.

10. The contact lens dispensing device of any of clauses 5-9, wherein the interior wall of each adjacent disk is at an angle of about 10 degrees with respect to a wall of the tube.
11. The contact lens dispensing device of any of clauses 5-10, wherein an underside of an external wall of a first adjacent disk abuts an upper side of external wall of a second adjacent disk.
12. The contact lens dispensing device of any of clauses 5-11, further comprising a hermetically sealed volume defined by the bottom wall of the first adjacent disk, the interior wall of the second adjacent disk, the external wall of the second adjacent disk and the bottom wall of the second adjacent disk.
13. The contact lens dispensing device of any of clauses 5-12, wherein a taper of each external wall with respect to a wall of the tube is sufficient to provide a luer lock between two adjacent external walls.
14. The contact lens dispensing device of any of clauses 5-13, wherein the external wall of each adjacent disk is at an angle of about 10 degrees with respect to a wall of the tube.
15. The contact lens dispensing device of any of clauses 3-14, wherein the central dome is sized to receive said contact lens thereon.
16. The contact lens dispensing device of any of clauses 3-15, wherein each disk further comprises a wall between the central dome and the flexible flange, wherein the wall has a height greater than the central dome to space the disk from an adjacent disk and hermetically seal a space between the central dome, the wall, and a disk adjacent an upper side of the central dome.
17. The contact lens dispensing device of any of clauses 3-15, wherein each disk further comprises a wall extending from a surface of the disk opposite the apex of the central dome between a rim of the central dome and the flexible flange, wherein the wall has a height greater than the central dome to space the disk from an adjacent disk in the tube and hermetically seal a space between the wall, the underside of the disk and a central dome of an adjacent disk.
18. The contact lens dispensing device of any of the preceding clauses, further comprising an actuator mechanism causing the advancement mechanism to eject a top-most one of said disks from the first end of the tube thereby presenting one of said contact lenses at the first end of the tube.
19. The contact lens dispensing device of any of the preceding clauses, further comprising a lid sized to hermetically seal the first end of the tube.
20. The contact lens dispensing device of clause 19, wherein the lid is pivotally connected to the first end of the tube.
21. The contact lens dispensing device of clause 19 or clause 20, further comprising a latch mechanism for securing the lid to the tube.
22. The contact lens dispensing device of clause 21, wherein the latch mechanism comprises an actuator mechanism causing the advancement mechanism to eject a topmost one of said disks from the first end of the tube thereby presenting one of said contact lenses at the first end of the tube.
23. The contact lens dispensing device of clause 1, wherein the disk is disposable.
24. The contact lens dispensing device of clause 1, wherein each disk comprises:

a central dome surrounded by a flexible flange, the flange forming an interference fit with a wall of a lumen of the tube.

25. The contact lens dispensing device of clause 24, wherein the dome is sized to receive said contact lens thereon.
26. The contact lens dispensing device of clause 24 or clause 25, wherein each disk further comprises a wall between the central dome and the flexible flange, wherein the wall has a height greater than the central dome to space the disk from an adjacent disk and hermetically seal a space between the central dome, the wall, and a disk adjacent an upper side of the central dome.
27. The contact lens dispensing device of any of clauses 24-26, wherein each disk further comprises a wall extending from a surface of the disk opposite the apex of the central dome between a rim of the central dome and the flexible flange, wherein the wall has a height greater than the central dome to space the disk from an adjacent disk in the tube and hermetically seal a space between the wall, the underside of the disk and a central dome of an adjacent disk.
28. A device for dispensing contact lens, comprising:

a holder, comprising:

a container having an end opening, a floor, and a wall extending from the floor to the end opening to define a cavity sized to receive a plurality of removable disks within the cavity; and a removable cap at the end opening and, in combination with the wall, providing a hermetic seal to the cavity;

an advancement mechanism urging the removable disks toward the first end of the tube, the first end of the tube adjacent the end opening of the holder upon insertion of the cartridge into the holder.

29. The device of clause 28, wherein the advancement mechanism is a spring in the cavity.
30. The device of clause 29, wherein the spring is a tensile spring at a bottom of the cavity.
31. The device of clause 29, wherein the spring is a coil spring at the bottom of the cavity biased toward the end opening.
32. The device of any one of clauses 28-31, wherein the container further comprises a latch fastening the removable cap to the container.
33. The device of clause 32, wherein the latch causes the removable cap to form a hermetic seal over the end opening.
34. The device of clause 32, wherein the latch comprises a tooth and a complementary recess, such that the cap is fastened to the container when the tooth is seated in the complementary recess.
35. The device of clause 34, wherein the latch is actuatable by a button to unseat the tooth from the complementary recess.
36. The device of clause 34, further comprising:

a cartridge insertable into the holder between the floor and the end opening, the cartridge comprising a tube having a cross-sectional profile smaller than a cross-sectional profile of the container and having a first end and a second end; the plurality of removable disks in the tube, moveable within the tube, wherein space between two adjacent removable disks within the tube is hermetically sealed for holding one of said contact lenses therein.

37. The device of any of clause 36, wherein the container further comprises a catch to hold the removable disks in tension against the advancement mechanism until the catch is released.
38. The device of clause 37, wherein the catch is released by actuation of a button.
39. The device of any of clauses 36-38 further comprising a push-button, actuation of the push-button causing one of the removable disks adjacent the end opening to advance out of the end opening.
40. The device of any of clauses 36-38, the replaceable cap further comprising a recess in a periphery of an interior of the removable cap such that a flange of one a topmost of the removable disks is caused to be received in the recess by bias force of the actuation mechanism.
41. The device of clause 40, further comprising including a depressible plunger extending through the replaceable cap from an exterior surface of the replaceable cap to adjacent an interior of the removable cap.
42. The device of clause 41, wherein depression of the plunger from the exterior side of the replaceable cap, causes deflection of a portion of the interior surface of the replaceable cap to displace the removable disk.
43. The device of clause 42, wherein depression of the plunger from the exterior side of the replaceable cap causes an interior surface of the plunger to displace the removable disk.
44. The contact lens dispensing apparatus of clause 1, wherein each removable disk comprises:

at least one peripheral protrusion having a first height and extending from a first surface of the disk, the peripheral protrusion spaced apart from a center of the disk by a first distance and having an edge spaced a first length from the first surface;

at least one rigid protrusion having a second height and extending from the first surface and spaced from the center of the removable disk by a second distance, wherein the second distance is less than the first distance; and a hermetic seal covering an expanse formed by the edge of the peripheral protrusion, thereby forming a hermetically sealed volume.

45. The contact lens dispensing apparatus of clause 44, wherein the peripheral protrusion is collapsible from the first height to a third height less than the second height such that the rigid protrusion breaks the hermetic seal upon collapse of the peripheral protrusion from the first height to the third height.
46. The contact lens dispensing apparatus of clause 44 or clause 45, wherein the hermetically sealed volume is defined by the peripheral protrusion, the rigid protrusion, and the hermetic seal.
47. The contact lens dispensing apparatus of clause 44, clause 45 or clause 46, further comprising a contact lens in solution in the hermetically sealed volume.
48. The contact lens dispensing apparatus of any one of clauses 44-47, wherein the peripheral protrusion comprises a flexible material.
49. The contact lens dispensing apparatus of any one of clauses 44-48, wherein the peripheral protrusion comprises a hinge.
50. The contact lens dispensing apparatus of any one of clauses 44-49, wherein the peripheral protrusion comprises a living hinge.
51. The contact lens dispensing apparatus of any one of clauses 44-50, further comprising a support rim around the edge of the peripheral protrusion.
52. The contact lens dispensing apparatus of any one of clauses 44-51, further comprising a support rim around the edge of the peripheral protrusion, wherein the support rim includes a projection extending in a direction non-parallel to the peripheral protrusion.
53. The contact lens dispensing apparatus of any one of clauses 44-52, further comprising:

a support rim around the edge of the peripheral protrusion, wherein the support rim includes a projection extending in a direction non-parallel to the peripheral protrusion; and a rib adjacent a radial region of the hermetic seal and extending in a direction non-parallel to the hermetic seal and away from the peripheral protrusion.

54. The contact lens dispensing apparatus of any one f clauses 44-53, further comprising at least one swing arm extending from the edge of the peripheral protrusion to a position adjacent an end of the at least one rigid protrusion.
55. The contact lens dispensing apparatus of any one of clauses 44-54, further comprising:

a cap at the first end of the end of the tube; and an opening at the second end of the tube.

56. The contact lens dispensing apparatus of clause 55, further comprising a ridge along an inside wall of the tube at the opening and configured to arrest movement of the removable disk such that the peripheral protrusion is compressed upon application of a force in the axial direction of the tube toward the second end of the tube.
57. The contact lens dispensing apparatus of any one of clauses 44-56, further comprising a depressible plunger adjacent the cap at the first end of the tube operably connected to the lumen of the tube to urge at least one of the removable disks toward the second end of the tube.
58. The contact lens dispensing apparatus of clause 57, wherein, upon depression of the plunger, the at least one of said removable disks is urged toward the second end of the tube, causing the peripheral protrusion to compress, causing the rigid protrusion to advance toward the fluid seal and cause the hermetic seal to break.
59. The contact lens dispensing apparatus of any one of clauses 57-58, wherein the depressible plunger is biased away from the lumen of the tube.
60. The contact lens dispensing apparatus of any one of clauses 57-59, wherein the depressible plunger is a push button.
61. The contact lens dispensing apparatus of any one of clauses 57-60, wherein the depressible plunger is a button and a stem biased away from the first opening of the tube.
62. The contact lens dispensing apparatus of any of the preceding clauses, further comprising slot in a wall of the tube or container whereby the removable disk is removable from the tube through the slot.

Not all the features described herein need to be incorporated into every package, and those of skill in the art, using the teachings herein, can combine the features to provide a wide variety of improved contact lens packages. In summary, the contact lens packages of the present invention incorporate several novel functionalities which may be combined in a wide variety of combinations as described herein to provide the desired improved and/or single touch packaging. The breadth and scope of the present invention should not be limited by any of the above-described exemplary embodiments but should be defined only in accordance with the following claims and their equivalents.

What is claimed is:

1. A contact lens dispensing device for dispensing one contact lens of a plurality of contact lenses, the device comprising:

a tube having a first end and a second end;

a plurality of removable disks in the tube, moveable within the tube, wherein space between two adjacent disks within the tube is hermetically sealed for holding one of said contact lenses therein; and an advancement mechanism urging the disks toward the first end of the tube.

2. The contact lens dispensing device of claim 1, wherein the removable disk is disposable.

3. The contact lens dispensing device of claim 1, wherein each removable disk comprises a central dome surrounded by a flexible flange, the flange forming an interference fit with a wall of a lumen of the tube.

4. The contact lens dispensing device of claim 1, wherein each removable disk comprises a central dome surrounded by a flexible flange, the flange forming an interference fit with a wall of a lumen of the tube; and wherein the flexible flange is separated from a periphery of the central dome by a u-shaped channel.

5. The contact lens dispensing device of claim 1, wherein each removable disk comprises a central dome surrounded by a flexible flange, the flange forming an interference fit with a wall of a lumen of the tube; and wherein the flexible flange is separated from a periphery of the central dome by a u-shaped channel; and wherein the u-shaped channel of each removable disk comprises an interior wall, an exterior wall, and a floor.

6. The contact lens dispensing device of claim 1, further comprising an actuator mechanism causing the advancement mechanism to eject a top-most one of said disks from the first end of the tube thereby presenting one of said contact lenses at the first end of the tube.

7. The contact lens dispensing device of claim 1, further comprising a lid sized to hermetically seal the first end of the tube.

8. The contact lens dispensing device of claim 1, further comprising a lid sized to hermetically seal the first end of the tube, wherein the lid is pivotally connected to the first end of the tube.

9. The contact lens dispensing device of claim 1, wherein each removable disk comprises a central dome surrounded by a flexible flange, the flange forming an interference fit with a wall of a lumen of the tube; and wherein the flexible flange is separated from a periphery of the central dome by a u-shaped channel; and wherein the u-shaped channel of each removable disk comprises an interior wall, an exterior wall, and a floor; and wherein an underside of the interior wall of a first removable disk abuts an upper side of the interior wall of a second removable disk.

10. The contact lens dispensing device of claim 9, wherein the abutment of the interior wall of the first one of the two adjacent disks and the interior wall of the second one of the two adjacent disks provides a hermetic seal for the space between the two adjacent disks.

11. The contact lens dispensing device of claim 9, wherein the abutment between the interior wall of the first adjacent disk and the interior wall of the second adjacent disk includes an interference fit.

12. The contact lens dispensing device of claim 9, wherein a taper of each interior wall with respect to a wall of the tube is sufficient to provide a luer lock between two adjacent interior walls.

13. The contact lens dispensing device of claim 9, wherein the interior wall of each adjacent disk is at an angle of about 10 degrees with respect to a wall of the tube.

14. The contact lens dispensing device of claim 9, wherein an underside of an external wall of a first adjacent disk abuts an upper side of external wall of a second adjacent disk.

15. The contact lens dispensing device of claim 9, further comprising a hermetically sealed volume defined by the bottom wall of the first adjacent disk, the interior wall of the second adjacent disk, the external wall of the second adjacent disk and the bottom wall of the second adjacent disk.

16. The contact lens dispensing device of claim 9, wherein a taper of each external wall with respect to a wall of the tube is sufficient to provide a luer lock between two adjacent external walls.

17. The contact lens dispensing device of claim 9, wherein the external wall of each adjacent disk is at an angle of about 10 degrees with respect to a wall of the tube.

18. The contact lens dispensing device of claim 1, wherein each removable disk comprises a central dome surrounded by a flexible flange, the flange forming an interference fit with a wall of a lumen of the tube; and wherein the central dome is sized to receive said contact lens thereon.

19. The contact lens dispensing device of claim 18, wherein each disk further comprises a wall between the central dome and the flexible flange, wherein the wall has a height greater than the central dome to space the disk from an adjacent disk and hermetically seal a space between the central dome, the wall, and a disk adjacent an upper side of the central dome.

20. The contact lens dispensing device of claim 18, wherein each disk further comprises a wall extending from a surface of the disk opposite the apex of the central dome between a rim of the central dome and the flexible flange, wherein the wall has a height greater than the central dome to space the disk from an adjacent disk in the tube and hermetically seal a space between the wall, the underside of the disk and a central dome of an adjacent disk.

21. The contact lens dispensing device of claim 1, further comprising a lid sized to hermetically seal the first end of the tube, and further comprising a latch mechanism for securing the lid to the tube.

22. The contact lens dispensing device of claim 21, wherein the latch mechanism comprises an actuator mechanism causing the advancement mechanism to eject a topmost one of said disks from the first end of the tube thereby presenting one of said contact lenses at the first end of the tube.

23. The contact lens dispensing device of claim 1, wherein the disk is disposable.

24. The contact lens dispensing device of claim 1, wherein each disk comprises a central dome surrounded by a flexible flange, the flange forming an interference fit with a wall of a lumen of the tube.

25. The contact lens dispensing device of claim 1, wherein each disk comprises a central dome surrounded by a flexible flange, the flange forming an interference fit with a wall of a lumen of the tube, and wherein the dome is sized to receive said contact lens thereon.

26. The contact lens dispensing device of claim 25, wherein each disk further comprises a wall between the central dome and the flexible flange, wherein the wall has a height greater than the central dome to space the disk from an adjacent disk and hermetically seal a space between the central dome, the wall, and a disk adjacent an upper side of the central dome.

27. The contact lens dispensing device of claim 25, wherein each disk further comprises a wall extending from a surface of the disk opposite the apex of the central dome between a rim of the central dome and the flexible flange, wherein the wall has a height greater than the central dome to space the disk from an adjacent disk in the tube and hermetically seal a space between the wall, the underside of the disk and a central dome of an adjacent disk.

28. The contact lens dispensing device of claim 1, wherein each removable disk comprises:

at least one peripheral protrusion having a first height and extending from a first surface of the disk, the peripheral protrusion spaced apart from a center of the disk by a first distance and having an edge spaced a first length from the first surface;

at least one rigid protrusion having a second height and extending from the first surface and spaced from the center of the removable disk by a second distance, wherein the second distance is less than the first distance; and a hermetic seal covering an expanse formed by the edge of the peripheral protrusion, thereby forming a hermetically sealed volume.

29. The contact lens dispensing device of claim 28, wherein the peripheral protrusion is collapsible from the first height to a third height less than the second height such that the rigid protrusion breaks the hermetic seal upon collapse of the peripheral protrusion from the first height to the third height.

30. The contact lens dispensing device of claim 28, wherein the hermetically sealed volume is defined by the peripheral protrusion, the rigid protrusion, and the hermetic seal.

31. The contact lens dispensing device of claim 28, further comprising a contact lens in solution in the hermetically sealed volume.

32. The contact lens dispensing device of claim 28, wherein the peripheral protrusion comprises a flexible material.

33. The contact lens dispensing device of claim 28, wherein the peripheral protrusion comprises a hinge.

34. The contact lens dispensing device of claim 28, wherein the peripheral protrusion comprises a living hinge.

35. The contact lens dispensing device of claim 28, further comprising a support rim around the edge of the peripheral protrusion.

36. The contact lens dispensing device of claim 28, further comprising a support rim around the edge of the peripheral protrusion, wherein the support rim includes a projection extending in a direction non-parallel to the peripheral protrusion.

37. The contact lens dispensing device of claim 28, further comprising:

a support rim around the edge of the peripheral protrusion, wherein the support rim includes a projection extending in a direction non-parallel to the peripheral protrusion; and a rib adjacent a radial region of the hermetic seal and extending in a direction non-parallel to the hermetic seal and away from the peripheral protrusion.

38. The contact lens dispensing device of claim 28, further comprising at least one swing arm extending from the edge of the peripheral protrusion to a position adjacent an end of the at least one rigid protrusion.

* * * * *